US008181709B2

(12) United States Patent
Oh

(10) Patent No.: US 8,181,709 B2
(45) Date of Patent: May 22, 2012

(54) MOUNTING STRUCTURE FOR SPRINKLER HEAD

(75) Inventor: Seung-il Oh, Seoul (KR)

(73) Assignee: Kofulso Co., Ltd., Incheon-Si (KR)

( * ) Notice: Subject to any disclaimer, the term of this patent is extended or adjusted under 35 U.S.C. 154(b) by 653 days.

(21) Appl. No.: 12/318,948

(22) Filed: Jan. 13, 2009

(65) Prior Publication Data

US 2010/0176258 A1 Jul. 15, 2010

(51) Int. Cl.
*A62C 37/10* (2006.01)
*B05B 15/06* (2006.01)

(52) U.S. Cl. ..... 169/37; 239/209; 239/600

(58) Field of Classification Search ..... 239/208, 239/209, 288, 600; 169/37, 38, 39, 40, 41, 169/90

See application file for complete search history.

(56) References Cited

U.S. PATENT DOCUMENTS

| | | | | | |
|---|---|---|---|---|---|
| 3,459,266 | A | * | 8/1969 | Ault | 169/37 |
| 3,612,461 | A | | 10/1971 | Brown | 248/317 |
| 3,652,780 | A | | 3/1972 | Wilson | 248/72 |
| 3,675,952 | A | * | 7/1972 | Mears | 285/302 |
| 3,874,035 | A | | 4/1975 | Schuplin | 248/72 |
| 4,117,887 | A | * | 10/1978 | Anderson | 169/37 |
| 4,135,692 | A | | 1/1979 | Ferguson | 248/317 |
| 4,717,099 | A | | 1/1988 | Hubbard | 248/57 |
| 4,723,749 | A | | 2/1988 | Carraro et al. | 248/317 |
| 5,002,318 | A | * | 3/1991 | Witter | 285/302 |
| 5,152,344 | A | * | 10/1992 | Fischer et al. | 169/37 |
| 5,595,363 | A | | 1/1997 | DeLeebeeck | 248/72 |
| 5,667,181 | A | | 9/1997 | van Leeuwen et al. | 248/343 |
| 6,260,810 | B1 | | 7/2001 | Choi | 248/65 |
| 6,345,800 | B1 | | 2/2002 | Herst et al. | 248/342 |
| 6,554,231 | B2 | | 4/2003 | Choi | 248/65 |
| 6,811,130 | B1 | | 11/2004 | Oh | 248/343 |
| 6,957,896 | B2 | * | 10/2005 | Burgess | 362/147 |
| 7,427,051 | B2 | | 9/2008 | Oh | 248/73 |
| 7,658,231 | B2 | * | 2/2010 | Rogers et al. | 169/37 |
| 7,942,345 | B2 | * | 5/2011 | Sesser et al. | 239/222.21 |
| 2003/0196821 | A1 | * | 10/2003 | Kikuchi et al. | 169/37 |
| 2006/0042802 | A1 | * | 3/2006 | Shim | 169/37 |
| 2007/0215720 | A1 | * | 9/2007 | Koiwa | 239/201 |
| 2011/0006514 | A1 | * | 1/2011 | Li et al. | 285/148.2 |

* cited by examiner

*Primary Examiner* — James Hewitt
(74) *Attorney, Agent, or Firm* — Jacobson Holman PLLC

(57) ABSTRACT

A mounting structure for a sprinkler head. The mounting structure includes a joint unit, a locking unit, an actuating unit, a head and a coupling unit. The joint unit includes a fitting part provided on the outer surface of the upper portion of the joint unit so that an airtight ring is fitted over the fitting part, a cylindrical part provided under the fitting part, a threaded part provided under the cylindrical part, and a through hole formed in the central portion of the joint unit. The locking unit has on its upper portion a plurality of locking pieces which are inserted into the fitting part. The actuating unit is fitted over the lower portion of the locking unit in such a way as to move up and down. The head has a threaded hole which corresponds to the threaded part. The coupling unit has an insertion hole into which the fitting part is inserted.

5 Claims, 16 Drawing Sheets

MOUNTING STRUCTURE FOR SPRINKLER HEAD

BACKGROUND OF THE INVENTION

1. Field of the Invention

The present invention relates to a mounting structure for a sprinkler head, which can be conveniently installed merely by pushing the head into a coupling unit to which a pipe is connected.

2. Description of the Related Art

A conventional mounting structure for a sprinkler head includes a coupling unit which is installed in a support structure in the ceiling of a room, and a head which is fastened to the coupling unit in a threaded manner.

In the conventional mounting structure for the head using the threaded fastening method, the preliminary operation of winding a seal tape around the threaded part of the head or applying a sealant to the threaded part of the head is required to prevent the leakage of water, so that the efficiency of construction work is poorer.

Further, in the case where the seal tape is loosely wound around the threaded part, and when the head is rotated to be fastened to the coupling unit in a threaded manner, the seal tape may not turn along with the threaded part. In this case, the insertion of the head into a threaded hole is imperfect, so that the leakage of water may occur.

In order to overcome the problem, the seal tape must be wound tightly around the threaded part. However, in this case, the thin and flexible seal tape may be cut, so that the winding work must be performed again.

Meanwhile, the sealant is a viscous liquid which has an adhesive property. The sealant is temporarily solidified. Thus, if an excessive amount of sealant is applied to the threaded part, some of the sealant flows into a portion in which the head is installed. Thereby, a stop valve adheres at a certain position because of the presence of the adhesive sealant, thus hindering the operation of the sprinkler in the event of a fire. In contrast, when a small amount of sealant is applied to the threaded part, there is a possibility of water leaking.

Further, the work of installing the head is conducted on a folding portable ladder or step stool with a worker facing upwards. In order to prevent water from leaking from a portion to which the head is fastened in a threaded manner, the worker must provide a proper tightening force even though he or she performs the work in an uncomfortable posture. Thus, even a skilled person has difficulty in evenly installing a plurality of sprinkler heads to a ceiling surface, and it takes a long time to install the sprinkler heads.

In the case where the tightening force for fastening the threaded part of the head is insufficient, the seal tape cannot reliably perform its function. In contrast, when the tightening force is too large, the seal tape gets damaged, so that water may leak and thus skilled workers are required.

SUMMARY OF THE INVENTION

Accordingly, the present invention has been made keeping in mind the above problems occurring in the prior art, and an object of the present invention is to provide a mounting structure for a sprinkler head which allows persons of ordinary skill to conveniently fasten the sprinkler head to a coupling unit without the necessity of performing complicated leakage preventing work of winding a seal tape around the threaded part of a head or applying a sealant to the threaded part.

In order to accomplish the above object, the present invention provides a mounting structure for a sprinkler head, including a joint unit, a locking unit, an actuating unit, a head and a coupling unit. The joint unit includes a fitting part which is provided on the outer surface of the upper portion of the joint unit so that an airtight ring is fitted over the fitting part, a cylindrical part which is provided under the fitting part, a threaded part which is provided under the cylindrical part, and a through hole which is formed in the central portion of the joint unit. The locking unit has on its upper portion a plurality of locking pieces which are inserted into the fitting part. The locking pieces are provided on the upper portions of inclined parts which are formed to be flared outwards by slits, so that the locking unit is fitted over the cylindrical part. The actuating unit is fitted over the lower portion of the locking unit in such a way as to move up and down. The head has a threaded hole which corresponds to the threaded part. The coupling unit has an insertion hole into which the fitting part is inserted, with a coupling groove formed at a predetermined position in the insertion hole so that the upper portions of the locking pieces are fitted into the coupling groove.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
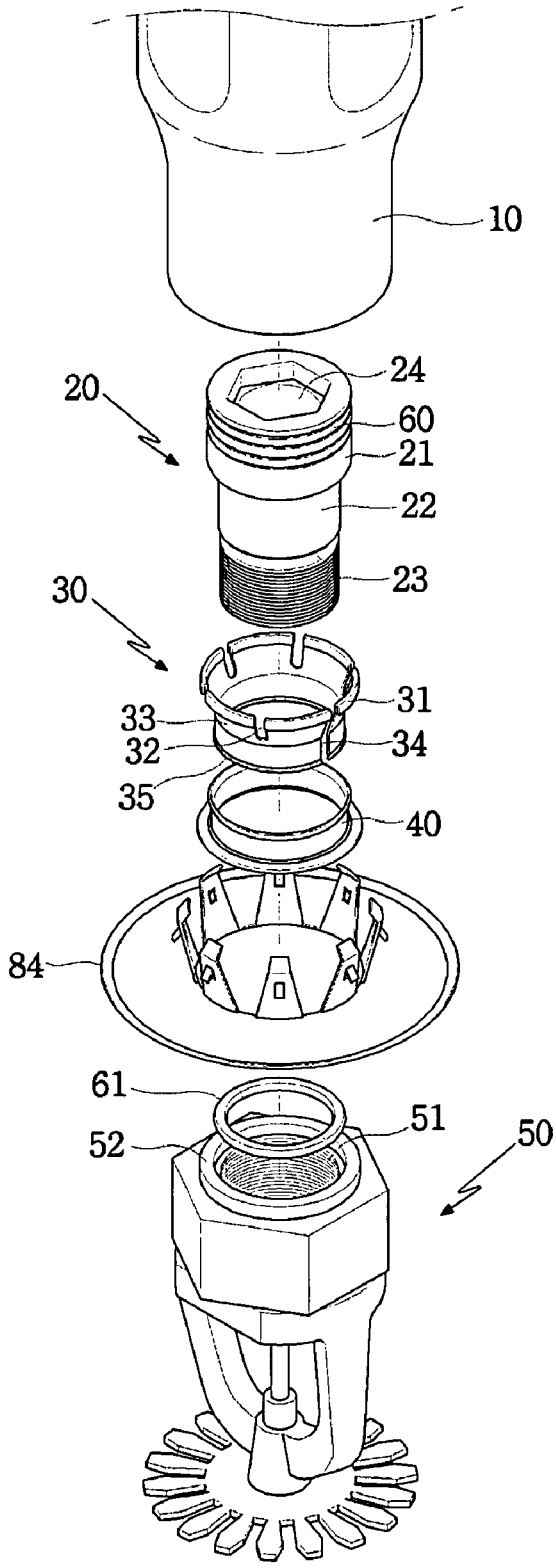
FIG. 1 is an exploded perspective view illustrating a mounting structure for a sprinkler head according to an embodiment of the present invention.
Figure 2:
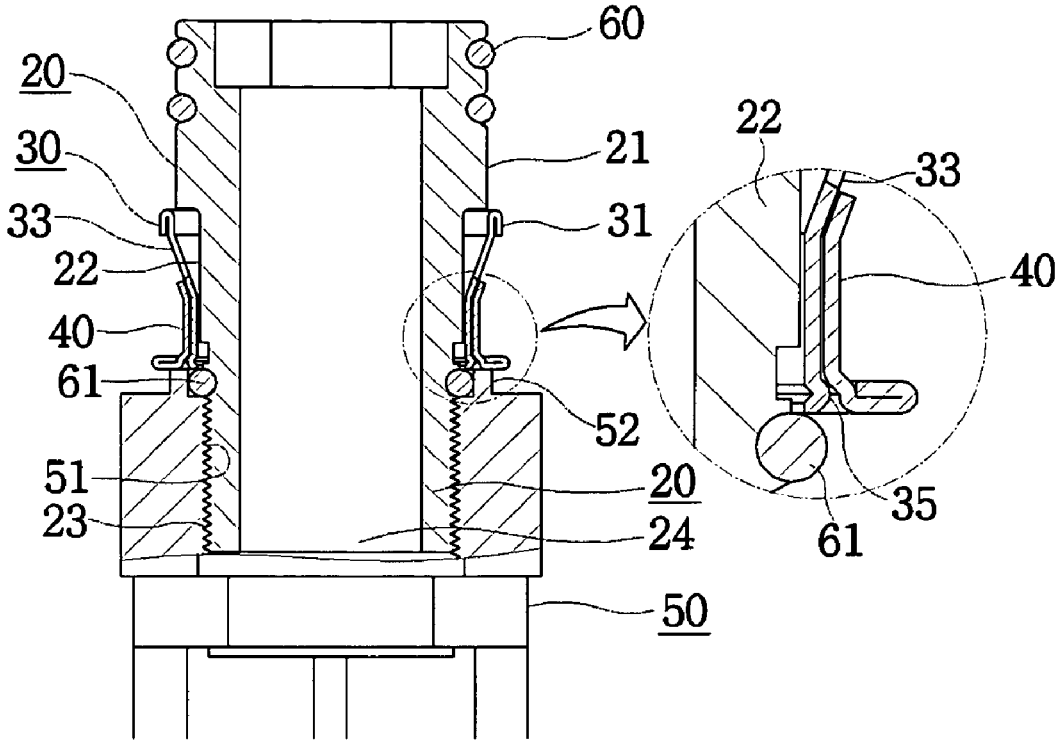
FIG. 2 is a sectional view illustrating the state in which a locking unit and an actuating unit are coupled to a joint unit of the present invention.

Hereinafter, the preferred embodiments of the present invention will be described in detail with reference to the accompanying drawings.

As shown in FIGS. 1 to 3D, a mounting structure for a sprinkler head according to the present invention is provided with a coupling unit 10, a joint unit 20, a locking unit 30, an actuating unit 40 and a head 50.

The joint unit 20 has on the outer surface of its upper portion a fitting part 21 over which is fitted a first airtight ring 60. Under the fitting part 21 is formed a cylindrical part 22.

Under the cylindrical part 22 is formed a threaded part 23. Further, a through hole 24 is formed in the central portion of the joint unit 20.

The locking unit 30 has on its upper end a plurality of locking pieces 31 which are inserted into the fitting part 21. The locking pieces 31 are provided on the upper ends of inclined parts 33 which are inclined outwards through slits 32. The locking unit 30 constructed as such is fitted over the cylindrical part 22.

The actuating unit 40 is installed to move up and down along the inclined parts 33 of the locking unit 30, and serves to narrow gaps between the locking pieces 31 when the joint unit 20 is separated from the coupling unit 10.

An opening 34 is formed at a predetermined position in the locking unit 30, and a locking step 35 protrudes from the lower end of the locking unit 30 to be stopped by a stopper which is provided at a lower position on the inner circumference of the actuating unit 40, thus preventing the locking unit 30 and the actuating unit 40 from becoming undesirably separated from each other.

The head 50 is a known part which has a threaded hole 51 which corresponds to the threaded part 23, and a protrusion 52 is provided on the upper end of the head 50 such that a second airtight ring 61 is fitted into the protrusion 52.

The coupling unit 10 has an insertion hole 11 into which the fitting part 21 is inserted. A coupling groove 12 is formed at a predetermined position in the insertion hole 11, so that the upper ends of the locking pieces 31 are fitted into the coupling groove 12.

The work of fastening the threaded part 23 of the joint unit 20 to the threaded hole 51 of the head 50 and fitting the second airtight ring 61 into the protrusion 52 is conducted in the manufacturing facility after which the product is supplied to a consumer, so that it is not necessary for the consumer to work in a uncomfortable posture, and thus working efficiency is not made poorer. Since the leakage of water is prevented by the second airtight ring 61, it is not necessary to apply an additional seal tape or sealant, thus making for convenient work.

The work of installing the sprinkler head according to the present invention constructed as described above is performed as follows.

Figure 3A:
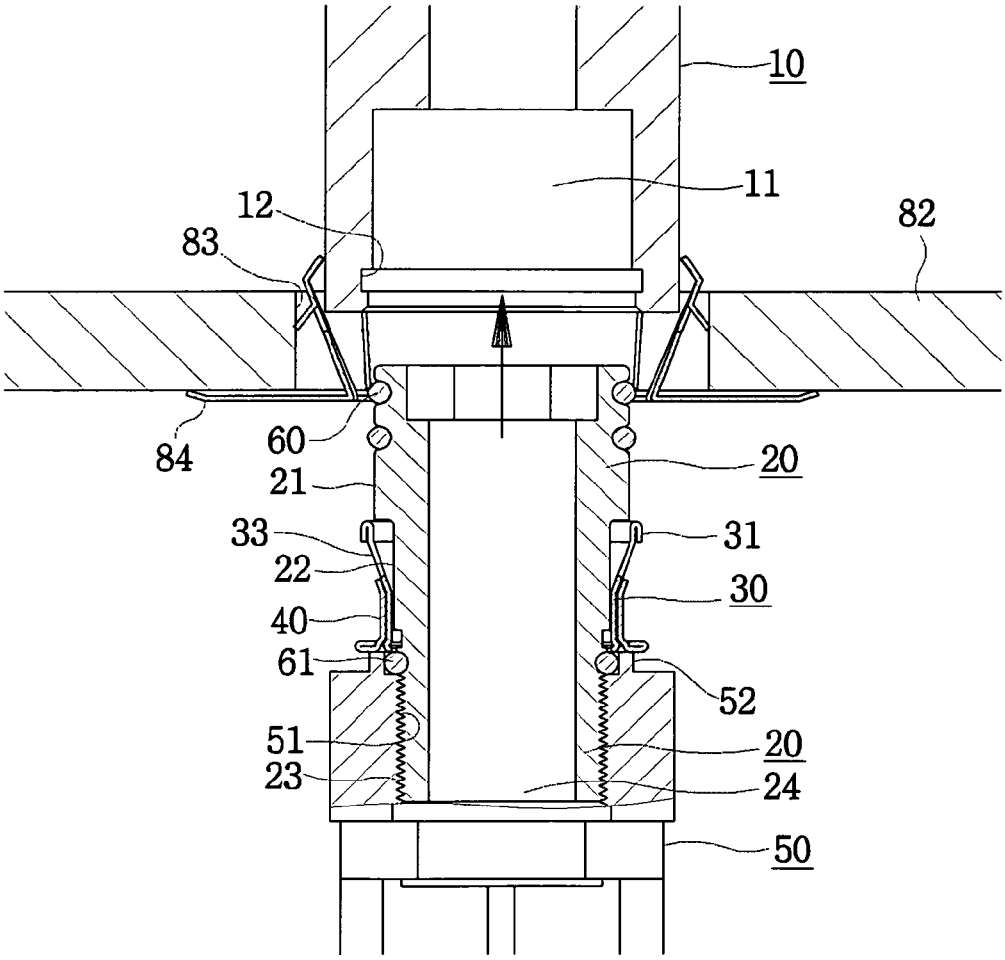
FIGS. 3A to 3D are sectional views illustrating the operation of installing the sprinkler head according to the present invention.

The coupling unit 10 is installed at a predetermined position on a ceiling support structure 80 via a clamp 81, and a closing part 82 having a hole 83 is installed to the support structure 80. In the state where a cover 84 is mounted to the hole 83 of the closing part 82, as shown in FIG. 3A, the joint unit 20 is pushed up such that the fitting part 21 is inserted into the insertion hole 11.

Figure 3B:
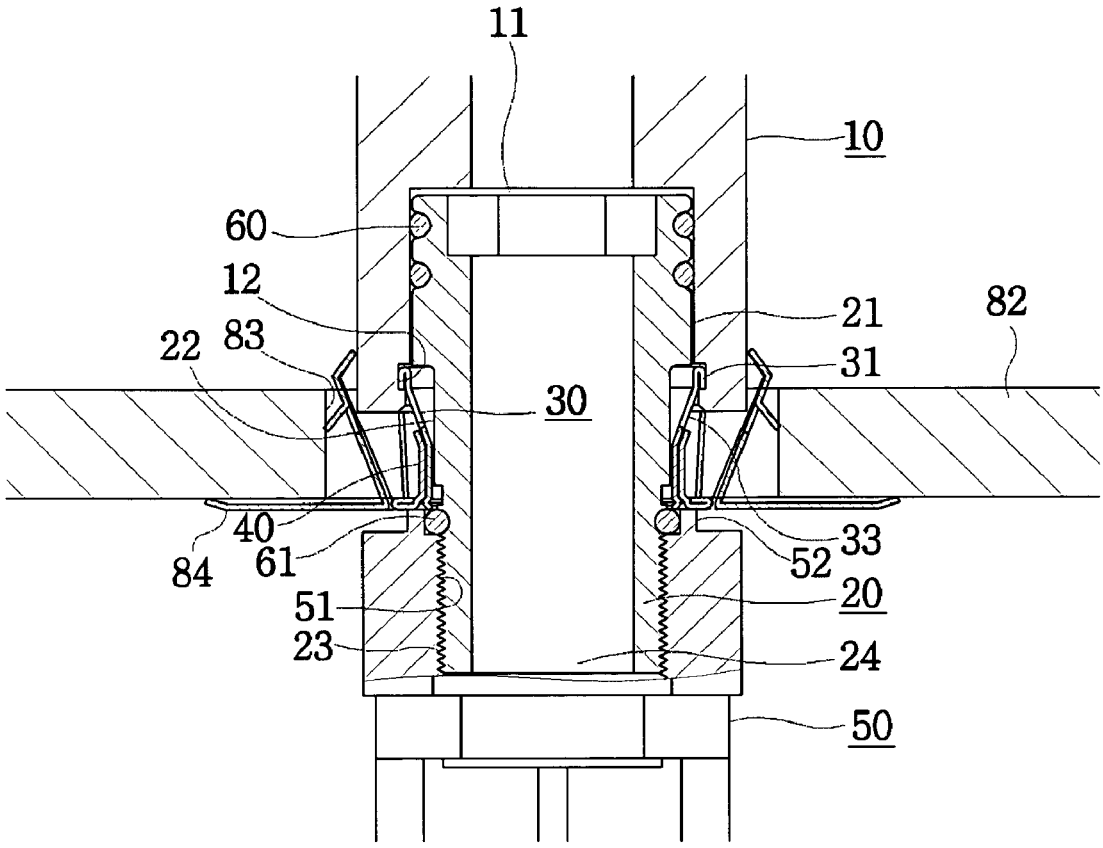

At this time, the locking pieces 31 which flare outwards are closed. Subsequently, when the locking pieces 31 reach the coupling groove 12 during the insertion, as shown in FIG. 3B, the locking pieces 31 are restored to their original states by their own elastic force.

Figure 3C:
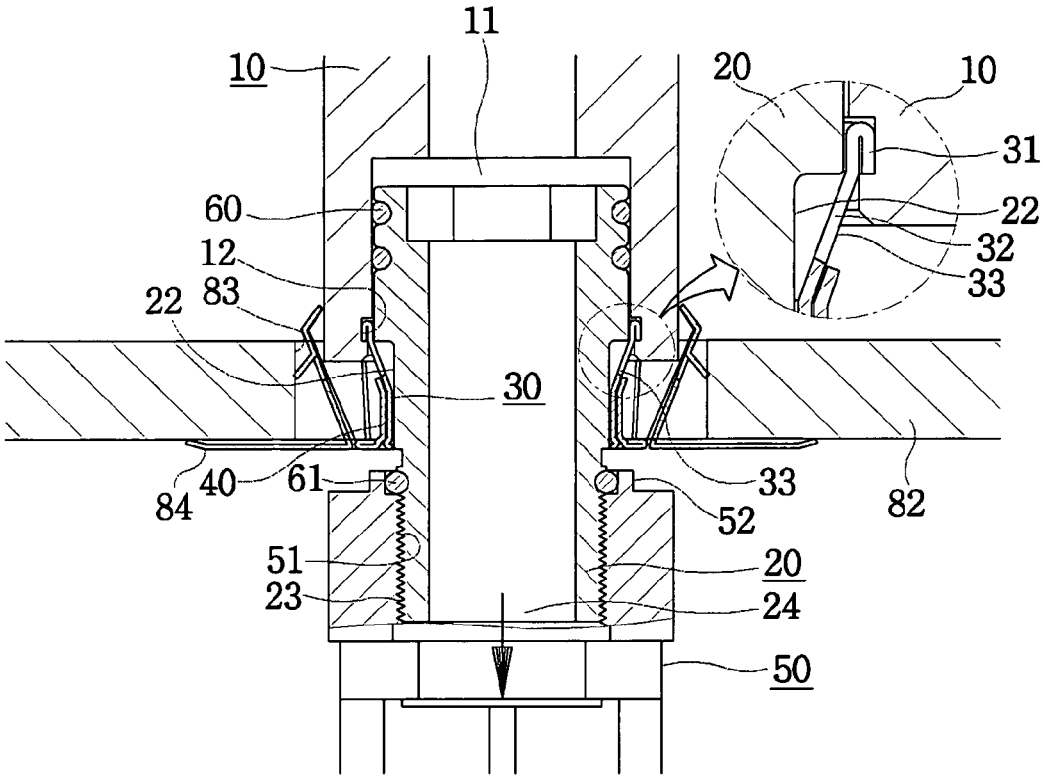
Figure 3D:
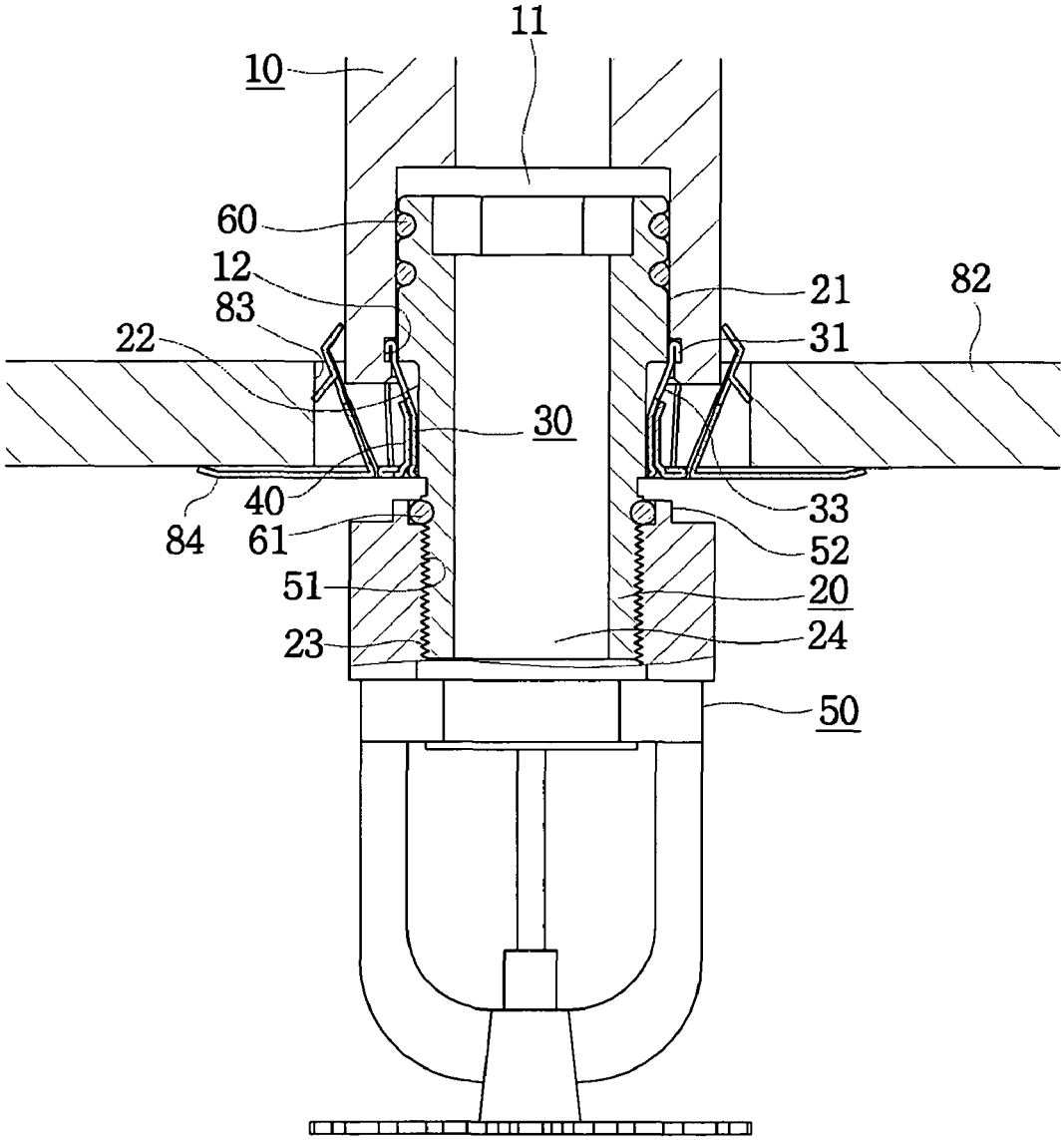

In such a state, when the joint unit 20 is pulled downwards, the fitting part 21 is fitted into the upper portions of the locking pieces 31, as shown in FIGS. 3C and 3D. Thereby, the work of installing the sprinkler head using the joint unit 20 and the coupling unit 10 is completed.

The airtight rings 60 and 61 serve to completely seal gaps between coupled parts, thus maintaining airtightness.

Figure 4A:
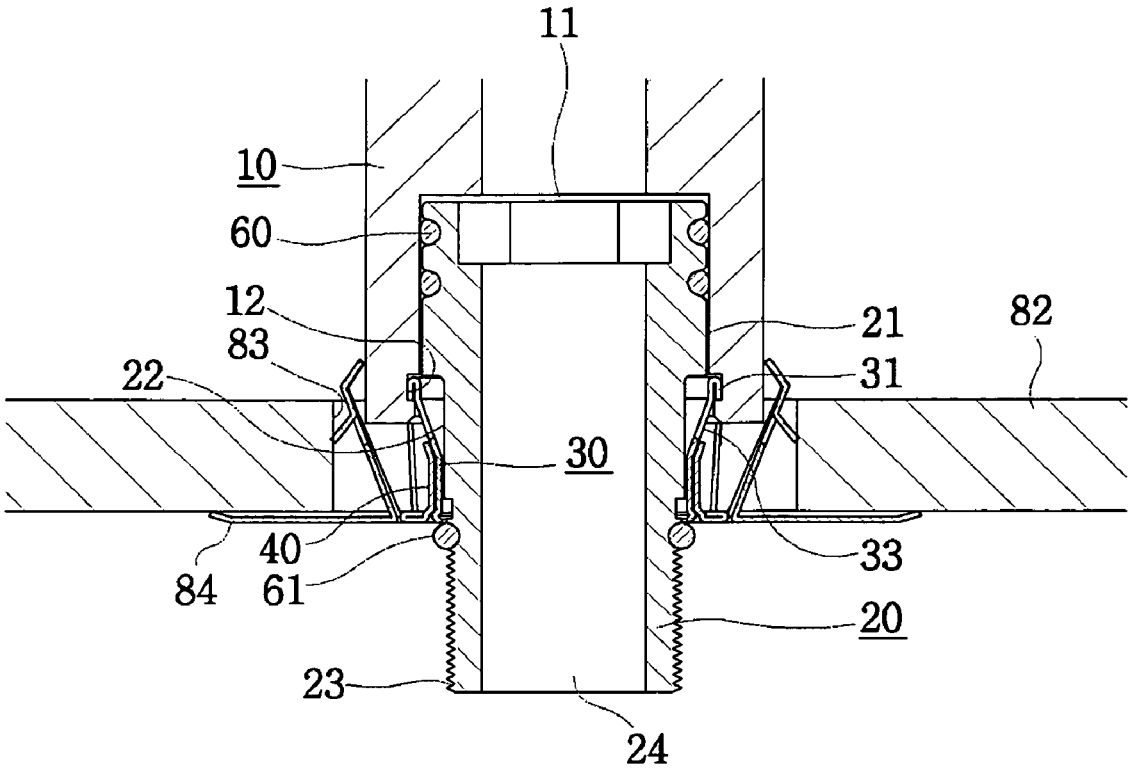
FIGS. 4A to 4D are sectional views illustrating the operation of separating the joint unit according to the present invention.

When a worker desires to separate the joint unit 20, as shown in FIG. 4A, the joint unit 20 is pushed upwards such that the fitting part 21 is removed from the locking pieces 31.

Figure 4B:
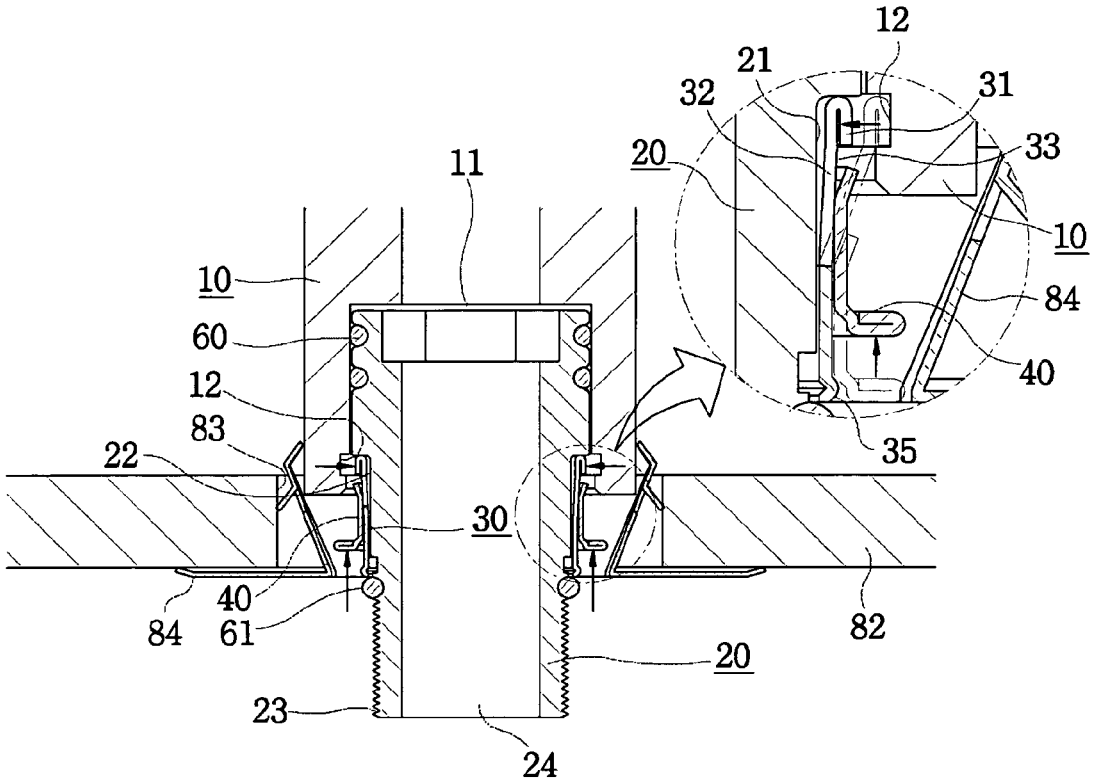

As shown in FIG. 4B, in the state where the fitting part 21 is released from the locking pieces 31, the actuating unit 40 is pushed upwards along the inclined parts 33. At this time, the locking pieces 31 are removed from the coupling groove 12, so that gaps between the locking pieces 31 narrow and close.

Figure 4C:
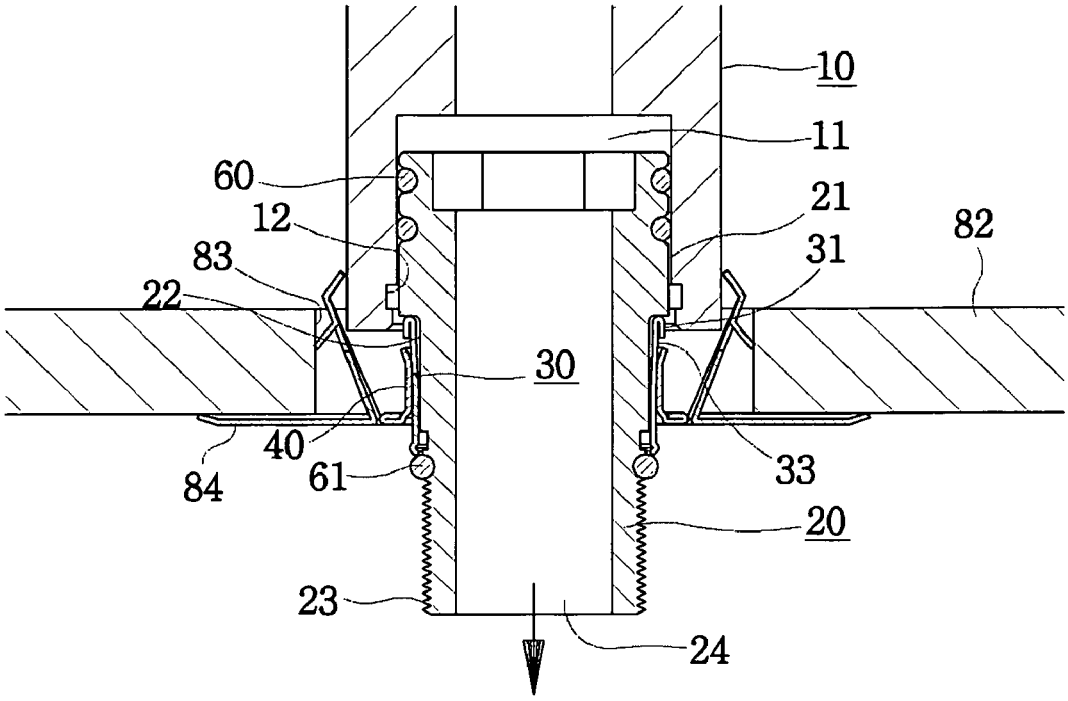
Figure 4D:
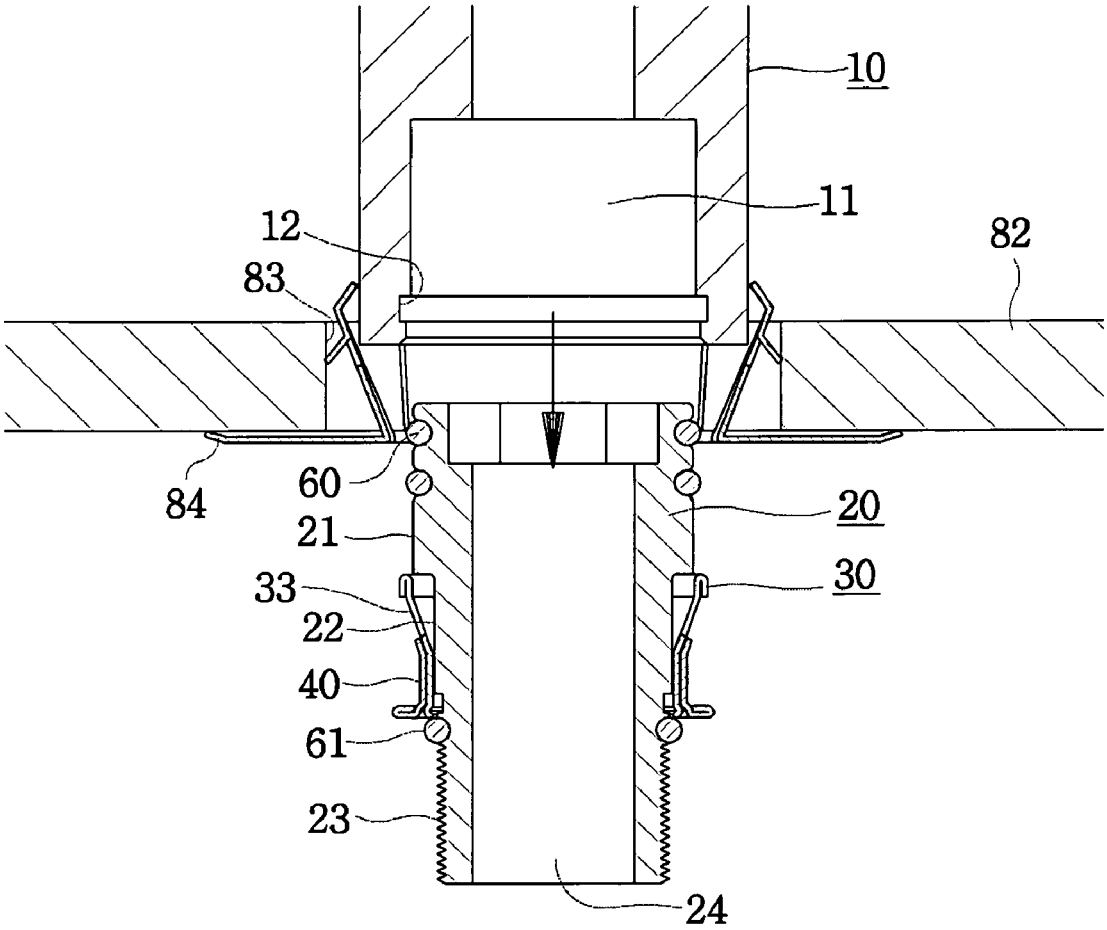

In such a state, when the joint unit 20 is pulled downwards, as shown in FIGS. 4C and 4D, the joint unit 20 separates from the coupling unit 10.

Figure 5:
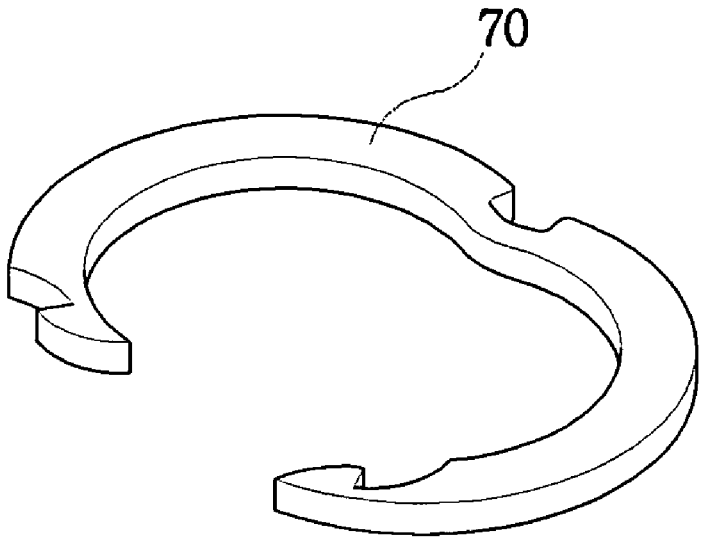
FIG. 5 is a perspective view illustrating a safety ring according to the present invention.
Figure 6:
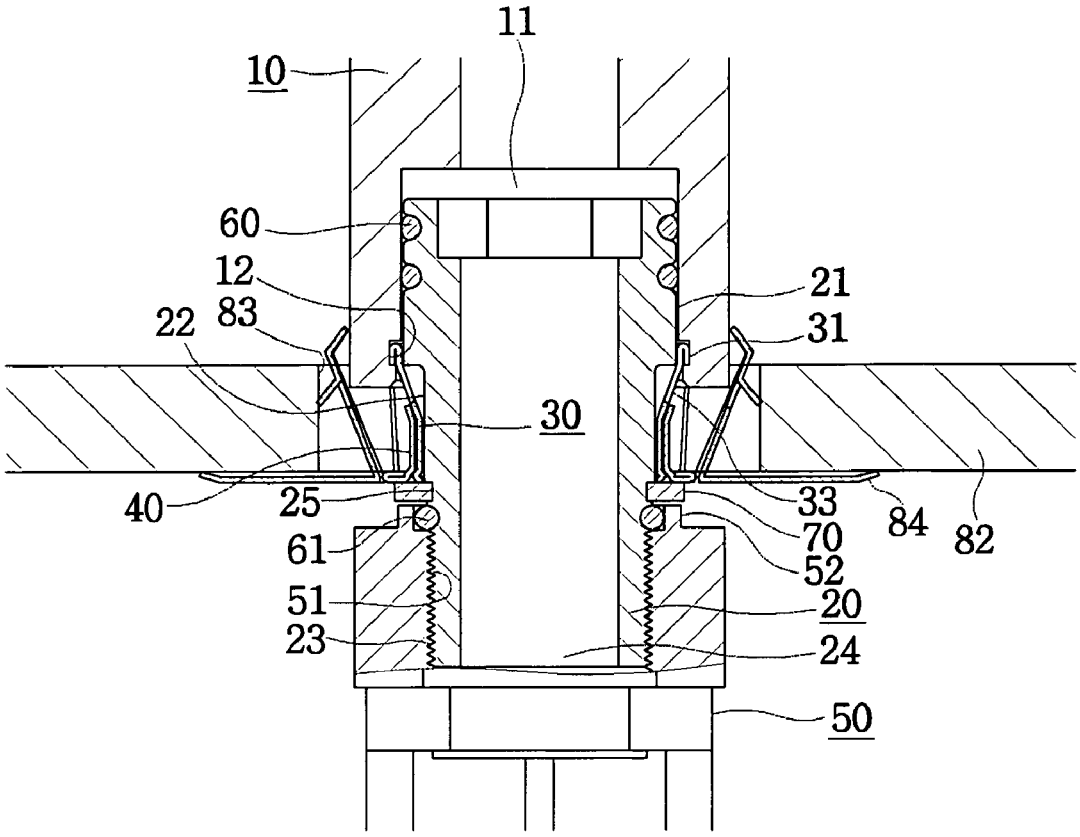
FIG. 6 is a sectional view illustrating the installed state of the safety ring of the present invention.

FIG. 5 is a perspective view illustrating a safety ring according to the present invention, and FIG. 6 is a sectional view illustrating the state in which the safety ring is mounted to the joint unit.

The safety ring 70 has the shape of a C which is open at a predetermined position, and is laterally fitted to a groove 25 formed in the cylindrical part 22 of the joint unit 20 and is closed in order to be secured to the cylindrical part 22. Thus, the safety ring 70 prevents the joint unit 30 from being moved upwards by the application of an external force.

That is, as shown in FIG. 6, when the safety ring 70 is fitted to the groove 25, the fitting part 21 is not removed from the locking pieces 31 even if a force for pushing the joint unit 20 up is applied, because the safety ring 70 simultaneously supports the locking unit 30 and the actuating unit 40. Thus, the locking pieces 31 are held in the coupling grooves 12.

As such, since the locking pieces 31 are held in the coupling groove 12, the joint unit 20 is not unexpectedly separated from the coupling unit 10 by the application of an abnormal external force.

FIGS. 5 and 6 illustrate the shape of the safety ring 70 according to one embodiment. The safety ring 70 may have any shape as long as it is open at a predetermined position and laterally fitted to the groove.

Figure 7:
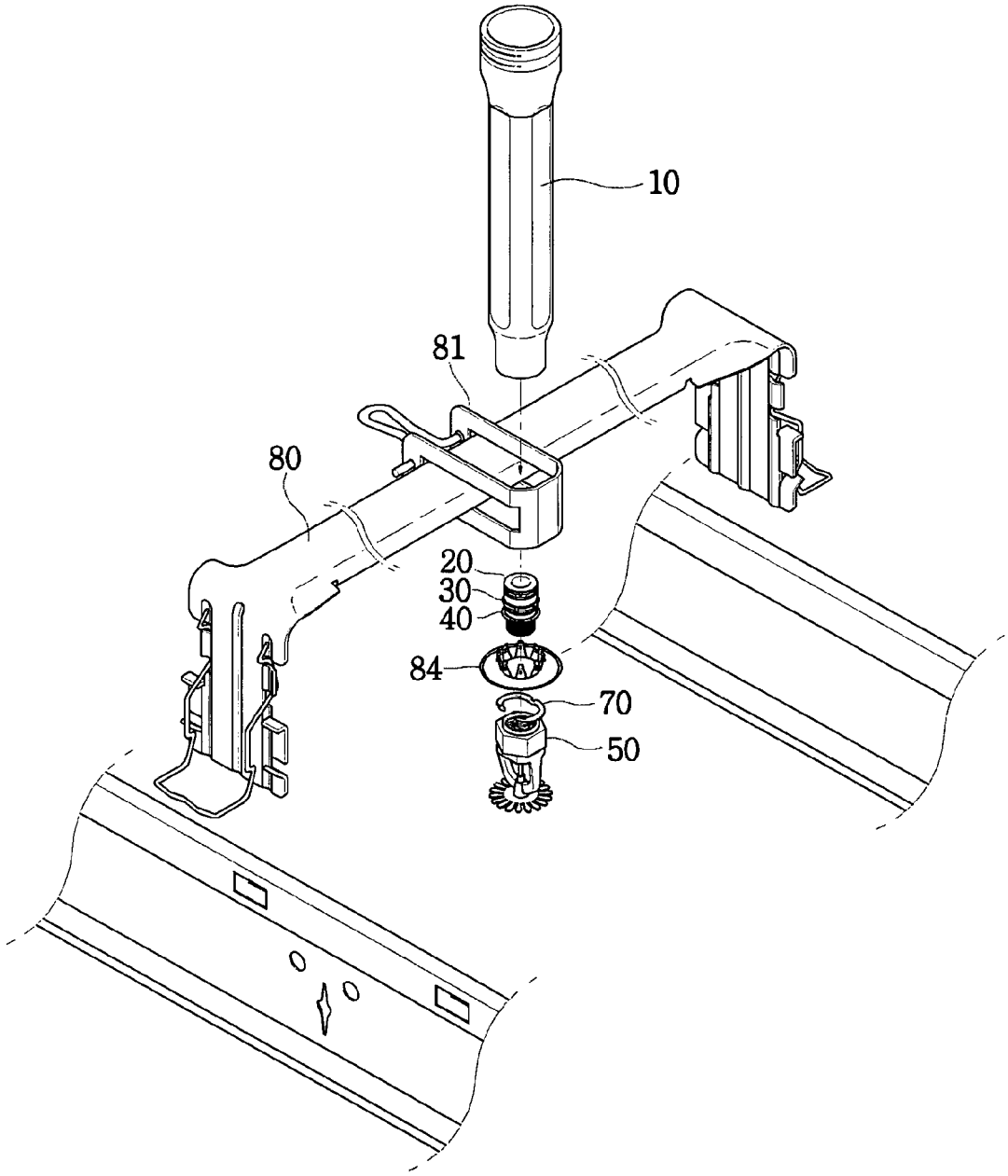
FIG. 7 is a perspective view illustrating the use of the mounting structure for the sprinkler head according to the present invention.

FIG. 7 is a view illustrating the coupling unit 10 which is installed at a predetermined position on the ceiling support structure 80 via the clamp 81, according to the present invention.

Figure 8A:
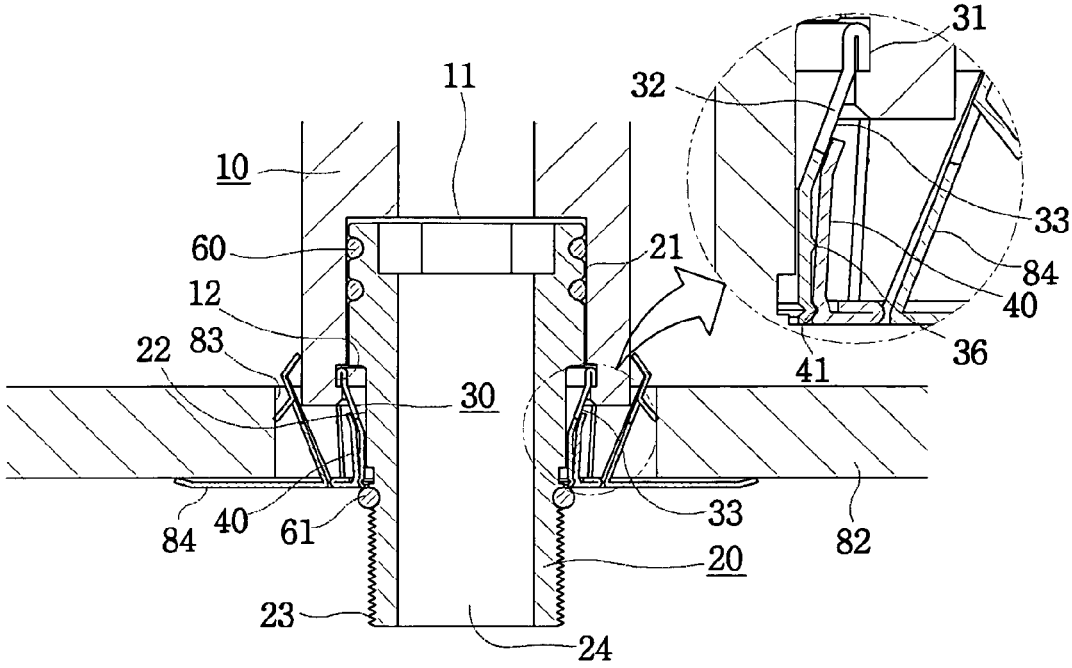
FIGS. 8A and 8B are sectional views illustrating another embodiment of an actuating unit according to the present invention.
Figure 8B:
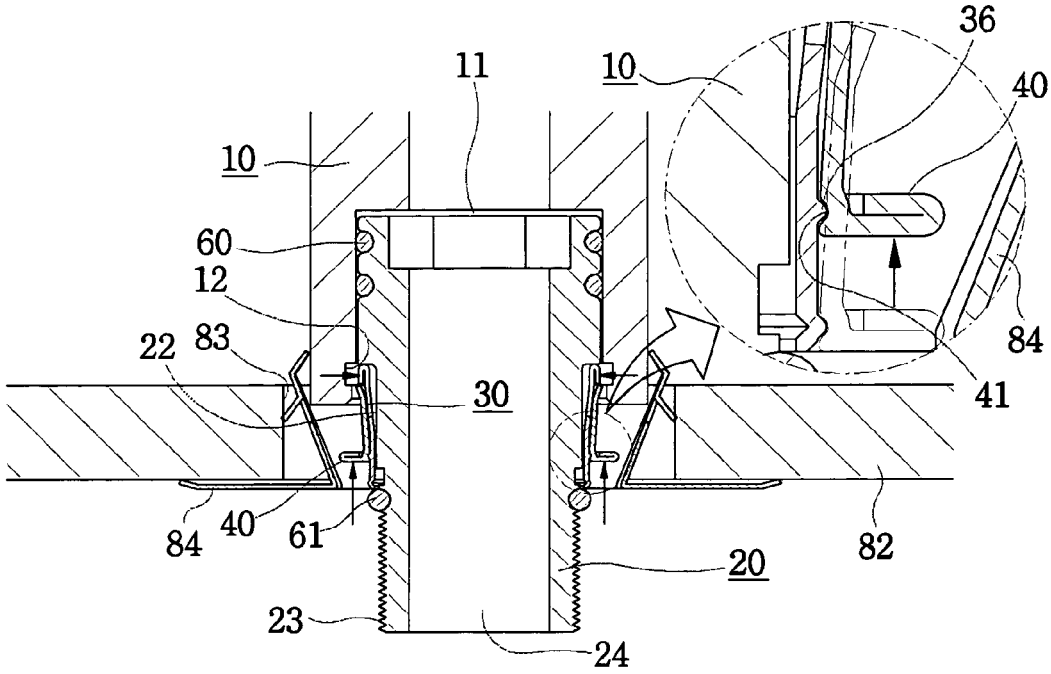

FIGS. 8A and 8B are sectional views illustrating an actuating unit 40 according to another embodiment of the present invention. As shown in the drawings, when the actuating unit 40 is pushed up so as to separate the joint unit 20 from the coupling unit, an embossing part 36 protruding from the outer circumference of the locking unit 30 is stopped by the stopper 41 of the actuating unit 40. Thus, even if external force is withdrawn, the actuating unit 40 is held fixed at the position to which it had been pushed. Thus, a worker need not hold the actuating unit 40 with his or her hand when the joint unit 20 is pushed up.

Figure 9:
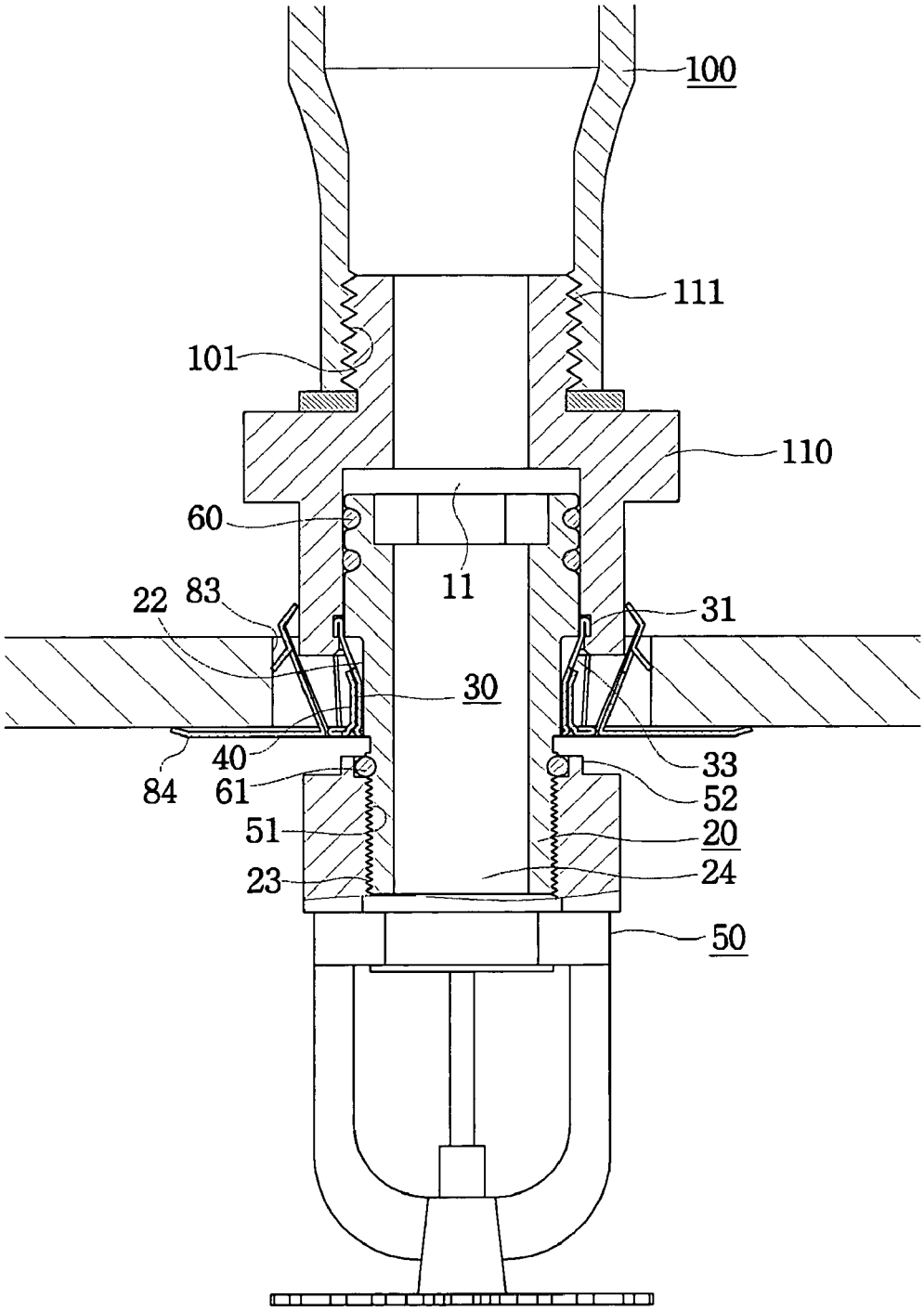
FIG. 9 is a sectional view illustrating the coupled state of a mounting structure for a sprinkler head according to another embodiment of the present invention.

FIG. 9 is a view illustrating another embodiment of the present invention. As shown in the drawing, a coupling unit 100 having in its lower portion a threaded hole 101 is used, as in the conventional mounting structure.

This embodiment further includes a middle unit 110 which includes an insertion hole 11 having a coupling groove 12, with a threaded part 111 provided on the outer surface of the upper portion of the middle unit 110. Thereby, a product passing through the process of coupling the threaded part 111 with the threaded hole 101 of the coupling unit 100 is supplied to a worker who will install the sprinkler head.

The mounting structure of the present invention may be applied to all existing types of sprinkler heads.

According to the present invention, a worker who stands on a folding portable ladder or step stool has only to insert the joint unit 20 into the coupling unit 10 and pull the joint unit 20 downwards, thus allowing the sprinkler head to be conveniently installed while preventing water from leaking from a junction between the coupling unit 10 and the joint unit 20.

What is claimed is:

1. A sprinkler head mounting structure, comprising:

a joint unit comprising:

a fitting part provided on an outer surface of an upper portion of the joint unit, an airtight ring is fitted over the fitting part;

a cylindrical part provided under the fitting part;

a threaded part provided under the cylindrical part; and a through hole formed in a central portion of the joint unit;

a locking unit having on an upper portion thereof a plurality of locking pieces which are inserted around the fitting part, the locking pieces being provided on upper portions of inclined parts which are flared outwards, the locking unit being fitted over the, cylindrical part;

an actuating unit fitted over a lower portion of the locking unit in such a way as to move up and down;

a head having a threaded hole which corresponds to the threaded part; and a coupling unit having an insertion hole into which the fitting part is inserted, with a coupling groove formed at a predetermined position in the insertion hole so that the locking pieces are fitted into the coupling groove.

2. The sprinkler head mounting structure as set forth in claim 1, wherein a groove is formed in the cylindrical part of the joint unit.

3. The sprinkler head mounting structure as set forth in claim 1, wherein an embossing part protrudes from an outer circumference of the locking unit, and a stopper corresponding to the embossing part is provided on an inner circumference of the actuating unit to stop the actuating unit at a position to which it had been pushed.

4. A sprinkler head mounting structure for a sprinkler head, comprising:

a joint unit comprising:

a fitting part provided on an outer surface of an upper portion of the joint unit, an airtight ring fitted over the fitting part;

a cylindrical part provided under the fitting part;

a threaded part provided under the cylindrical part; and a through hole formed in a central portion of the joint unit;

a locking unit having on an upper portion thereof a plurality of locking pieces which are inserted around the fitting part, the locking pieces being provided on upper portions of inclined parts which are flared outwards, the locking unit being fitted over the cylindrical part;

an actuating unit fitted over a lower portion of the locking unit in such a way as to move up and down;

a head having a threaded hole which corresponds to the threaded part;

a middle unit having a coupling groove at a predetermined position in an insertion hole into which the fitting part is inserted, so that the locking pieces are fitted into the coupling groove, with a threaded part formed on an outer surface of an upper portion of the middle unit; and a coupling unit having on a lower portion thereof a threaded hole so that the threaded part engages with the threaded hole.

5. The sprinkler head mounting structure as set forth in claim 4, wherein a groove is formed in the cylindrical part of the joint unit.

* * * * *